US005322092A

United States Patent [19]

Howeth et al.

[11] Patent Number: 5,322,092

[45] Date of Patent: Jun. 21, 1994

[54] SYSTEM FOR TRANSFERING USED REFRIGERANT FROM MULTIPLE SMALL RECOVERY CYLINDERS TO LARGE SHIPPING CYLINDER

[75] Inventors: D. Frank Howeth, Ft. Worth, Tex.; S. M. Tranchina, Pitman, N.J.

[73] Assignee: E. I. Du Pont de Nemours and Co., Wilmington, Del.

[21] Appl. No.: 868,715

[22] Filed: Apr. 14, 1992

[51] Int. Cl.[5] ..... B65B 1/04; B65B 3/04

[52] U.S. Cl. ..... 141/3; 141/4; 141/7; 141/66; 62/77; 62/149; 62/292; 137/614

[58] Field of Search ..... 141/59, 2, 3, 4, 5, 141/7, 18, 65, 66, 105, 18, 346, 382, 383, 347; 62/77, 149, 292; 137/208, 209, 210, 614; 251/148

[56] References Cited

U.S. PATENT DOCUMENTS

| | | | |
|---|---|---|---|
| 2,625,410 | 1/1953 | Crowley | 251/148 |
| 2,715,317 | 8/1955 | Rhodes | 62/149 |
| 2,919,144 | 12/1959 | Lindenmeyer | 251/148 |
| 4,261,178 | 4/1981 | Cain | 62/149 |
| 4,539,817 | 9/1985 | Staggs et al. | 62/149 |
| 4,542,774 | 9/1985 | Stavlo | 141/1 |
| 4,805,416 | 2/1989 | Manz et al. | 62/292 |
| 5,088,436 | 2/1992 | Stritmatter | 141/18 |
| 5,117,641 | 6/1992 | Keltner | 62/475 |

*Primary Examiner*—Henry J. Recla
*Assistant Examiner*—Steven O. Douglas
*Attorney, Agent, or Firm*—Hubbard, Tucker & Harris

[57] ABSTRACT

Apparatus and method for operating the apparatus is disclosed for transferring reclaimed refrigerant from multiple recovery cylinders to a larger shipping cylinder using a vapor compressor and four-way valve to first transfer liquid refrigerant and then vapor to the shipping cylinder. This system includes flexible hoses for liquid and vapor transfer and employs valves near the couplings for connections of the hoses to the cylinders. Operating methods then permit transfer from successive cylinders to the shipping cylinders and changeouts in the shipping cylinders without loss of significant refrigerant to the atmosphere, and without inclusion of air into the refrigerant in the shipping cylinder.

17 Claims, 13 Drawing Sheets

L1
L2
L3
152
MANUAL
154
25 AMP
25 AMP
25 AMP
156
H1
H2
H3
H4
X1
X2
3A
3A
4A
115V-AC
162
158
STOP
START
1
3
3
5
164
3
4
176
168
170
150
2CRI
LIGHT (RED)
162
65
160
350 PSI SWITCH
2CR
LIGHT (GREEN)
3CRI
164
63
3CR
16" Hg SWITCH
61
ICR
FLOAT SWITCH
CMR4
172
174
LIGHT (RED)
1CRI
166
180
HM
BMR
ICR2
SOL
CR2
3CR2
OR1
CMR
CMR1
CMR2
CMR3
OR
OR
OR
66
CM
BMR2
BMR1
C
F
BM

250

VALVE POSITIONS BEGINNING THIS OPERATION

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | X | X | X | X | X | X | X | X | X | X |
| OFF | | ▶2 | | | | | | | | |

| FLOW DIRECTING VALVE 54 | |
|---|---|
| LIQUID | X |
| VAPOR | ▶3 |

VALVE POSITIONS BEGINNING THIS OPERATION 250

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | X | | X | X | X | X | X | X | X | X |
| OFF | ▶1 | X | ▶1 | ▶1 | | | | | | |

| FLOW DIRECTING VALVE 54 | |
|---|---|
| LIQUID | |
| VAPOR | X |

250

VALVE POSITIONS BEGINNING THIS OPERATION

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | ▶2 | X | X | X | X | X | X | X | X | X |
| OFF | X | | | | | | | ▶2 | | |

| FLOW DIRECTING VALVE 54 | |
|---|---|
| LIQUID | X |
| VAPOR | ▶3 |

250

VALVE POSITIONS BEGINNING THIS OPERATION

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | X | X | X | X | X | X | X | X | X | X |
| OFF | ▶1 | ▶1 | ▶1 | | | | | | ▶1 | |

| FLOW DIRECTING VALVE 54 | |
|---|---|
| LIQUID | |
| VAPOR | X |

VALVE POSITIONS BEGINNING THIS OPERATION 250

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | | | ▶1 | X | X | X | | | | X |
| OFF | X | X | X | ▶1 | | | X | X | X | ▶1 |

| FLOW DIRECTING VALVE 54 | |
|---|---|
| LIQUID | X |
| VAPOR | |

250

VALVE POSITIONS BEGINNING THIS OPERATION

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | | | | | X | X | ▶2 | ▶1 | ▶1 | ▶2 |
| OFF | X | X | X | X | | | X | X | X | X |

| FLOW DIRECTING VALVE 54 | |
|---|---|
| LIQUID | X |
| VAPOR | |

250

VALVE POSITIONS BEGINNING THIS OPERATION

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | X | X | X | X | X | X | | | | X |
| OFF | ▶2 | ▶2 | ▶2 | | | | X | | | |

| FLOW DIRECTING VALVE 54 | |
|---|---|
| LIQUID | |
| VAPOR | X |

VALVE POSITIONS BEGINNING THIS OPERATION 250

| 2 WAY VALVES | | | | | | | | | | |
|---|---|---|---|---|---|---|---|---|---|---|
| VALVE | 1 | 2 | 3 | 4 | 5 | 6 | 7 | 8 | 9 | 10 |
| ON | | | ▶1 | X | X | X | | | | |
| OFF | X | X | X | ▶1 | | | X | | | X |

| FLOW DIRECTING VALVE 54 | |
|---|---|
| LIQUID | X |
| VAPOR | |

SYSTEM FOR TRANSFERING USED REFRIGERANT FROM MULTIPLE SMALL RECOVERY CYLINDERS TO LARGE SHIPPING CYLINDER

FIELD OF THE INVENTION

Method and apparatus for transferring refrigerants, or other phase change liquids, from a number of small recovery cylinders to a larger shipping cylinder for transporting the refrigerant back to a central processing plant without releasing significant amounts of the refrigerant vapors to the atmosphere.

BACKGROUND OF THE INVENTION

Since as early as the 1600's, importance has been placed on cooling space or substances below ambient temperature. By 1930, it was discovered that when certain refrigerants underwent liquid-gas phase changes, large amounts of latent heat were absorbed and could be used to effect cooling. Today, such refrigerants are used throughout the world in annual volumes measured in the thousands of tons. Unfortunately, many of these refrigerants are now known to significantly damage the atmosphere and environment. By 1990, over fifty nations had agreed to phase out the production of chloroflorocarbons (CFC's) by the year 2000 and hydrochloroflorocarbons (HCFC's) by the year 2040. The United States has also passed statutes which, in effect, create the objective of immediately reducing emissions of these substances to the lowest achievable levels throughout the production, distribution, use and recapture for reuse, reprocessing or final disposal.

Equipment for handling these substances through production, distribution, and use have been generally available in the past simply because of the value of the product for sale at the time it enters use. However, no equipment or procedures have heretofore existed for recovering these substances without significant losses to the atmosphere. Not only must such equipment assure loss control, but it also must be cost effective and safe, but must also adapt to varieties of refrigerants, refrigeration system lubricants, and other contaminants. Furthermore, to permit reclamation and reuse of refrigerants, the reclamation equipment must prevent cross contamination of the products. Such equipment must accommodate refrigerants having various rapid phase change characteristics and must do so in a manner to permit safe normal functioning of the equipment under virtually all climatic conditions. The equipment must minimize inclusion of non-condensible gases, such as air, with the refrigerant in the ultimate storage and shipping cylinder. Further, the equipment must retain refrigerant contaminants, such as lubricants, until the reprocessing can effectively refine the refrigerants. The problem of reclamation is further complicated by the fact that the many tons of refrigerants which are to be recaptured from market use are not distributed evenly over the geographic area of use.

The U.S. Department of Transportation (DOT) has approved pressure cylinders in two sizes for refrigerant recovery and shipping. A small cylinder (see FIG. 1, hereafter described) will hold about fifty pounds of liquid refrigerant and are used by repairman to transfer used refrigerant from the refrigeration equipment to a collection point. The cylinder includes two valves, a vapor valve connected to the upper portion of the cylinder. Larger shipping cylinders (see FIG. 2 hereafter described) are capable of holding about 1000 pounds of liquid refrigerant and includes a similar arrangement of vapor and liquid valves.

At the present there are two basic means for transferring refrigerant liquids and vapors from one chamber to the other. One is commonly referred to as single direction pumping of both refrigerant liquids and vapors, and a bi-directional procedure in which only vapor is pumped, by a reversible vapor pump (see FIGS. 3*a*–3*c* hereafter described).

In the single direction pumping procedure, a liquid vapor pump is connected to the liquid valve and the liquid-vapor pump first draws liquid form the recovery cylinder and forces the liquid into the shipping cylinder. As liquid is removed from the recovery cylinder, the vapor pressure drops which in turn permits a portion of liquid in the cylinder to vaporize to maintain the vapor pressure. In other words as liquid is being removed form the cylinder, an amount remaining in the cylinder is undergoing phase change to maintain a relatively constant vapor pressure over the liquid in the cylinder. Upon completion of liquid transfer, the pump continues operating and vapors are down from the recovery cylinder in diminishing volume and compressed into the shipping cylinder where an amount converts to liquid phase. Vapor transfer from the small cylinder continues and the refrigerant vapors are eventually removed sufficiently from the recovery cylinder to prevent contaminating or mixing with the same or other types of refrigerants.

The single direction pumping of recovered refrigerant liquids and vapors has a number of problems: Non-vaporizing and heavy contaminates are concentrated in the diminishing liquid volume of the recovery cylinder. Dip tube inlets are not necessarily positioned exact to the bottom of the cylinder and the scavenging vapor flow velocity up through the tube is ever diminishing. Accordingly, an amount of contaminants such as compressor oil is likely to be retained in the recovery cylinder. Combination liquid-vapor pumps are inherently less efficient than vapor pumps because of the relation of fluid pressure, liquid versus gas viscosity and pump displacement relative to horsepower. Consequently single direction refrigerant pumping is typified by a long vapor draw-down cycle.

A number of problems are associated with current bi-directional vapor pumping systems for means of transferring recovered refrigerants. The transfer conduits fill with non-condensible air when the cylinders are disconnected and the air becomes trapped in the recovery cylinders and shipping cylinders subsequently attached. This gas is eventually transferred to the shipping cylinder and being non-condensible can prevent complete filling with liquid refrigerant. When the cylinders are disconnected from the attached conductors, the refrigerant is vented to the atmosphere. The capacity to transfer from only one recovery cylinder to the shipping cylinder is inefficient and not cost effective. There is no means for determining when all liquid refrigerant and liquid contaminants are transferred from the recovery cylinder so that the vapor pump can be reversed to begin vapor draw-down. If reversed while liquid is still in the recovery cylinder, then transferring the vapor can take longer and damage the vapor pump. The vapor pressure and accordingly vapor density at the vapor pump intake varies depending upon refrigerant temperature. If the system is designed to transfer the liquid at an efficient rate under the most unfavorable conditions, then there is a likelihood that the vapor will be heated excessively as it is pumped into the recovery cylinder. Heated vapors drawn from the recovery cylinders and transferred into the shipping cylinders progressively induce a higher level of retained vapor pressure with each transfer operation, eventually exceeding the safe operation of the system. Improperly directing the vapor pump to draw vapors when in fact liquid transfer is required can result in overfilling recovery cylinders with liquid from the shipping cylinders and can result in ingesting the liquid refrigerant into the pump. The same can occur if the shipping cylinder becomes overfilled with liquid during liquid transfer.

Pumping refrigerant vapors is a well developed art and offers a wide variety of reliable vapor pumps in various sizes. This fact coupled with limited vapor pumping capacity of combination liquid-vapor pumps potentially makes bi-directional vapor pumping the desired method for production transfer of recovered refrigerants. The present invention is of an improved Transfer System providing features necessary to fulfill regulatory demands for controlling refrigerants and further accommodating the needs of industry in processing large volumes of recovered refrigerants.

SUMMARY OF THE INVENTION

The present invention is concerned with a system, including apparatus and method, for transferring recovered refrigerant from one or more smaller cylinders, substantially simultaneously, to a larger shipping cylinder without significant loss of refrigerant to the atmosphere or the significant inclusion of atmospheric gas into the storage cylinder, all in a safe, efficient and convenient manner. The system allows for the detachment of one or more of the smaller recovery cylinders, essentially simultaneously, and the subsequent attachment of other filled recovery cylinders without significant loss of refrigerant to the atmosphere or inclusion of atmospheric gas. Similarly, the system makes it possible to detach a filled shipping cylinder and reattach an empty shipping cylinder without significant loss of refrigerant or inclusion of air into the system. This can all be achieved in such a manner as to prevent cross contamination of the system if the system is intended to handle a different type of refrigerant.

More specifically, the present invention includes a vapor system interconnecting the vapor valve of the recovery cylinder with the vapor valve of the shipping cylinder and a liquid system connecting the liquid valve of the shipping cylinder to the liquid valve of the shipping cylinder. The vapor system includes a vapor compressor and a flow directing valve for selectively causing the vapor compressor to pump vapor selectively from the shipping cylinder to the recovery cylinder or in the alternative, from the recovery cylinder to the shipping cylinder. The liquid system is connected through a flexible hose to each of the respective liquid valves on the cylinders by means of a suitable quick-disconnect coupling, and a valve is disposed immediately adjacent each coupling. Similarly, the vapor system is also connected to each of the vapor valves of the respective cylinders by a flexible hose and quick-disconnect coupling and also includes a valve disposed closely adjacent each of the respective couplings. As a result of the valves being disposed adjacent each of the flexible couplings, procedures can be employed to withdraw all liquid, and also essentially remove the vapor within the quick-disconnected couplings so that the cylinders can be disconnected from the system without significant loss of refrigerant vapor to the atmosphere. This arrangement also permits procedures to use the compressor and a plurality of dedicated recovery cylinders, to purge the system of any gas which is resident in the system. For example, residual vapors of a particular refrigerant can be withdrawn from the system and collected in such a manner so as not to pollute the atmosphere, while preventing cross-contamination of that particular refrigerant with a different type of refrigerant which is to be processed next. Similarly, air can be essentially eliminated from the system at any time so that the air is not included with the next refrigerant transferred from the recovery cylinders to shipping cylinders.

In accordance with another very important aspect of the present invention, both the vapor system and the liquid systems have manifolds which permit liquid to be transferred from a plurality of recovery cylinders substantially simultaneously. Sight glasses are provided in the manifold of the liquid system for each of the recovery cylinders so that the operator can determine when liquid refrigerant has been exhausted from the respective cylinders. Continued flow of vapor to the liquid free recovery cylinders can then be terminated to expedite the transfer of liquid from the remaining recovery cylinders.

A manually operable valve is provided to control vapor passing into the compressor so as to control the output volume and prevent overheating during the liquid transfer cycle. A heat exchanger is provided to cool the vapors being pumped from the recovery cylinders into the shipping cylinder to prevent excess pressure buildup due to energy put into the vapor by the compressor. The vapor compressor is protected from ingesting liquid by means which automatically responds to a buildup of liquid in a wet sump and which operates a control valve. Operation of the compressor is automatically terminated when the vapor pressure at the input, which corresponds to the vapor pressure in the recovery cylinders, reaches a predetermined low level, signifying that the vapor transfer cycle has terminated.

In accordance with another important aspect of the present invention, the system is physically embodied in a workbench having a generally waist-high work surface upon which a number of recovery cylinders can be placed at manifold stations. A back panel rises vertically from the rear of the work surface and supports the liquid and vapor manifolds and associated hoses and valves and overlaid by a protective guard rail, with the components in clear view of the operator to facilitate use of the system. The work surface preferably includes a resilient mat to minimize noise and prevent the recovery cylinder from moving around during operation of the compressor, which is supported on a shelf under the work surface. The shipping cylinder is positioned on scales so as to determine when it has its capacity of liquid refrigerant.

The system of the present invention includes a high-efficiency vapor compressor which is connected by a two-position four-way valve to the respective vapor valves of the respective cylinders so as to selectively be connected to draw vapor from a shipping cylinder and pump it through a vapor manifold to one or more recovery cylinders, or alternatively, to withdraw vapor from one or more recovery cylinders through the vapor manifold and pump it through the vapor valve of the shipping cylinder.

Those skilled in the art will recognize and appreciate other features and advantages of the present invention from the following detailed description of the preferred embodiment when read in conjunction with the accompanying drawings, and from the invention as further defined by the appended claims.

DETAILED DESCRIPTION OF THE DRAWINGS

Figure 1:
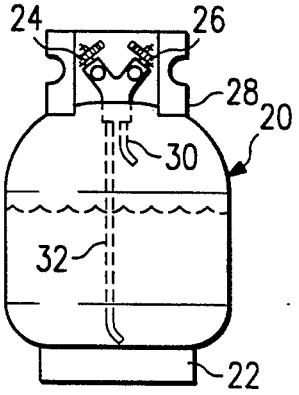
FIG. 1 (PRIOR ART)
FIG. 1 is a somewhat schematic illustration of a small recovery cylinder which is typically used by repairmen in the field to collect refrigerant for transport a central collection facility.

Referring now to the drawings, a small refrigerant recovery cylinder is indicated generally by the reference numeral 20 in FIG. 1 and is of the type which is approved by the United States Department of Transportation for handling such refrigerants. The cylinder includes a base 22 and a manually operable liquid valve 24 and a manually operable vapor valve 26 which are enclosed within and protected by a partial ring flange 28. The valve include a conventional threaded coupling for receiving a quick disconnect. The vapor valve 26 is connected to a pipe 30 which terminates at the upper end of the cylinder so as to preferentially draw vapor from the cylinder, while the liquid valve 24 is connected to a pipe 32 which extends to a point near the bottom of the chamber so as to preferentially withdraw the liquid phase of the refrigerant.

Figure 2:
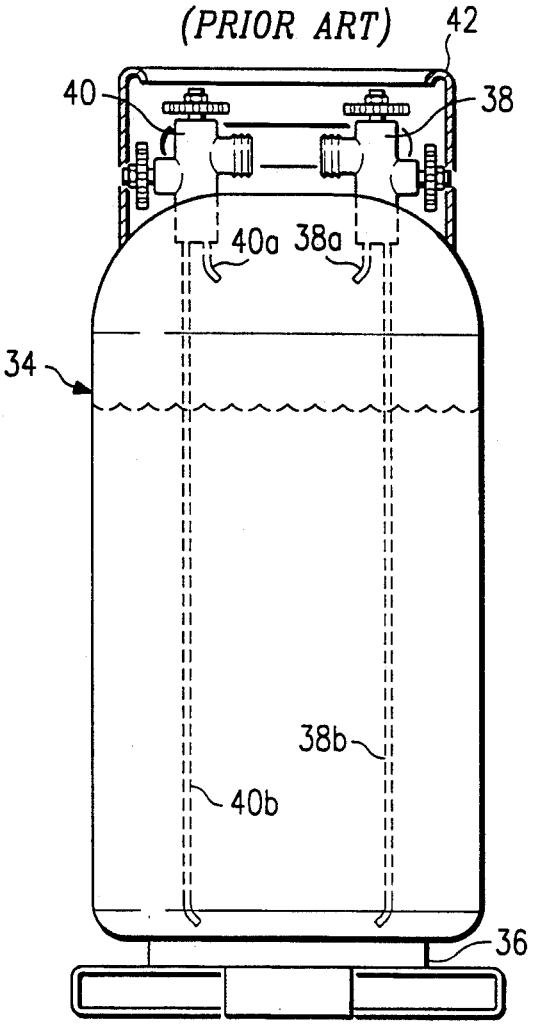
FIG. 2 (PRIOR ART)
FIG. 2 is a somewhat schematic illustration of a large shipping cylinder capable of transporting about one thousand pounds of refrigerant.

A large shipping cylinder 34 is illustrated in FIG. 2 and is of the type approved by the United States Department of Transportation. This cylinder is sized to hold approximately one thousand pounds of liquid refrigerants and includes a base 36 with integral fork lift loops, and two separate double valves 38 and 40, each of which includes a vapor valve connected to vapor pipes **38*a* and 40*a* respectively, and liquid valves connected to liquid pipes 38*b* and 40*b* respectively. A protective collar 42** is provided around the top of the cylinder to prevent damage to the valves in shipping.

Figure 3A:
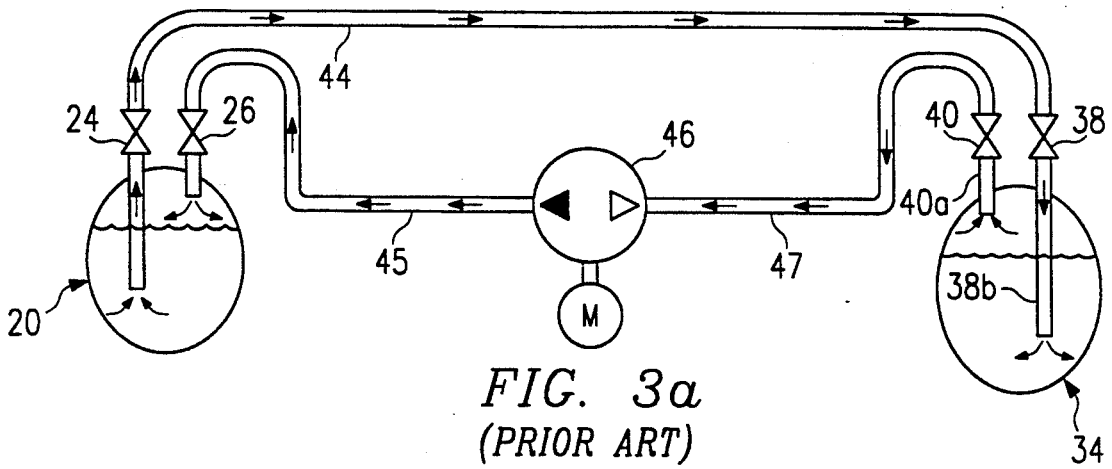
FIG. 3a (PRIOR ART)
FIG. 3A–3C collectively illustrate steps of a prior art bi-directional pumping method for transferring large volumes of refrigerants from one vessel to another.
Figure 3B:
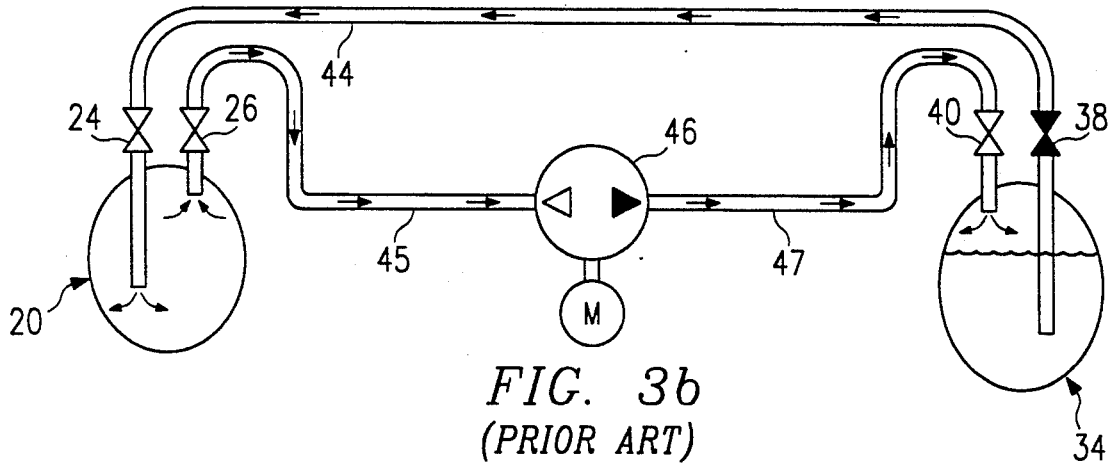
FIG. 3b (PRIOR ART)
Figure 3C:
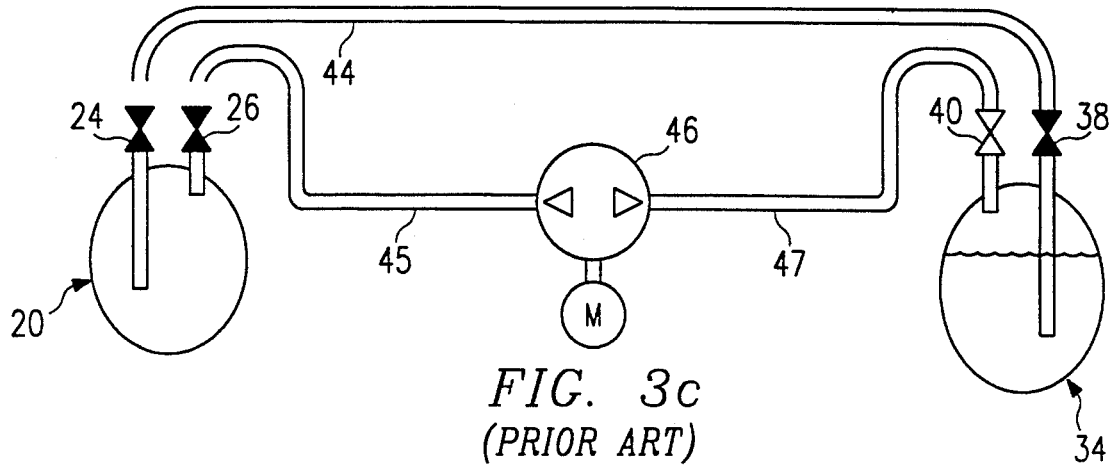
FIG. 3c (PRIOR ART)

The conventional prior art method for transferring liquid from one container, recovery cylinder 20, for example, to another container, shipping container 34, for example, is illustrated in FIGS. 3A–3C. In this method, a liquid flow conduit 44 is connected between liquid valve 24 and the liquid valve of the dual valve 38 so as to be connected to the standpipe **38*b*. A bi-directional vapor pump 46 is connected to the vapor valve 26 of the recovery cylinder 20 and to the vapor valve of dual valve 40 as to be connected to flow pipe 40*a*. The first step of the procedure is to open all valves and operate the bi-directional vapor pump so as to withdraw vapor from the shipping cylinder 34 and transfer the vapor through the vapor valve of the recovery cylinder 20. This increases the pressure in the recovery cylinder which forces liquid from the recovery cylinder 20 by way of conduit 44 to the shipping cylinder 34. When all liquid has been transferred in this manner, the liquid valve 38 is closed, as illustrated in Step Two in FIG. 3*b*, so that liquid cannot be withdrawn from the shipping container and the vapor pump 46 is reversed. Vapor is then withdrawn from the recovery cylinder 20 as well as conduit 44 and forced into the shipping cylinder 40** where the increased pressure causes the vapors to condense.

Next, as illustrated in Step Three of FIG. **3*c*, the valves 24 and 26 of the collection cylinder 20 are closed and disconnected from conduits 44 and 45. At that time, any remaining vapors in conduits 44 and 45 are vented to the atmosphere, and vapor under pressure is trapped in line 47 between the pump 46 and valve 40. Then the valve 40 is also closed and the pump 46 again reversed to reduce the vapor pressure in the conduit 47 so that it can be disconnected from the shipping cylinder 34**.

Figure 7:
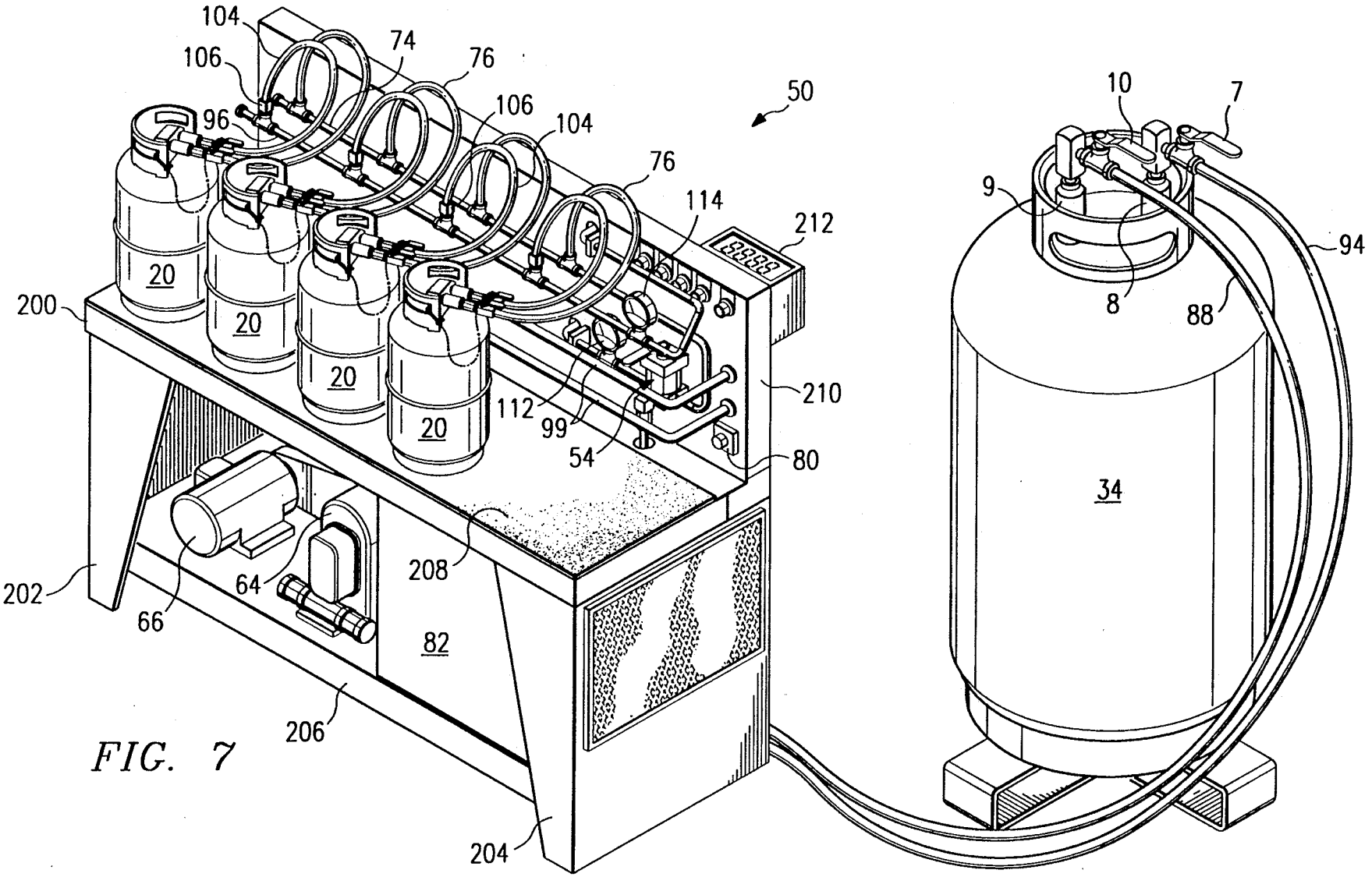
FIG. 7 is a somewhat schematic perspective view of the combined system of FIGS. 4 and 5.

Referring now to FIG. 7, a system in accordance with the present invention is indicated generally by the reference numeral 50. The system 50 includes a refrigerant system indicated generally by the reference numeral 52 in FIG. 4. The system 52 includes a flow directing valve 54 having four parts. The valve has two positions, one being termed a liquid recovery position illustrated by dotted outline **54*a*, and the other a vapor recovery position indicated generally by the reference numeral 54*b*. An intake loop to a compressor 64 is comprised of conduit 56, which is connected to a first port of valve 54, solenoid operated on/off valve 58, wet sump 60, and conduit 62 which is connected to the intake of compressor 64. The compressor is driven by an electric motor 66. An output loop from the compressor includes conduit 68, oil separator 70, and conduit 72 which is connected to a second port of valve 54. A third part of the flow control valve 54 is connected to a vapor line which includes a manually settable one direction flow control valve 80, and parallel branches including a heat exchanger 82 in one branch, and a one-way check valve 84 in one branch, and an oppositely formed check valve 86 in the other branch. The parallel branches are then connected through a manual valve 6 and a flexible conduit 88 to the valve 9 on the shipping cylinder 34, the valve 9 comprising either of the valves 38 or 40** appropriately opened to vapor ports 38*a* or 40*a*. The valve 10 is conveniently connected to the valve 9 by means of a suitable quick connect coupling 90. Valve 54 is connected by conduit 72 to a vapor manifold 74 and then by flexible conduits 76 to a set of valves 3 which are adapted to be connected to the vapor valves 4 shown in FIG. 4 of the recovery vessels 20 by means of suitable quick connect couplings 78.

A normally opened mercury switch 63 is connected to sense the pressure in conduit 62 and is set to close when the pressure within the conduit 62 falls below a preselected value, typically 16 inches of mercury, to terminate operation of motor 66. Similarly, a safety switch 65 is connected to monitor the pressure in conduit 68 and is set to close whenever the pressure in the conduit 68 exceeds some preselected maximum, such as 350 psi, to disable the motor 66. Additionally, a pressure relief valve 67 is also connected to the conduit 68 and is set to release pressure at some pressure above that of the electric switch 65, such as 400 psi.

Figure 5A:
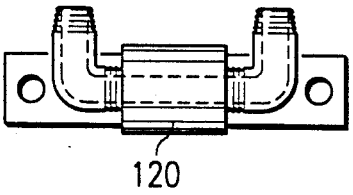
FIG. 5A is a somewhat schematic illustration of a portion of the system shown in FIG. 4.
Figure 5:
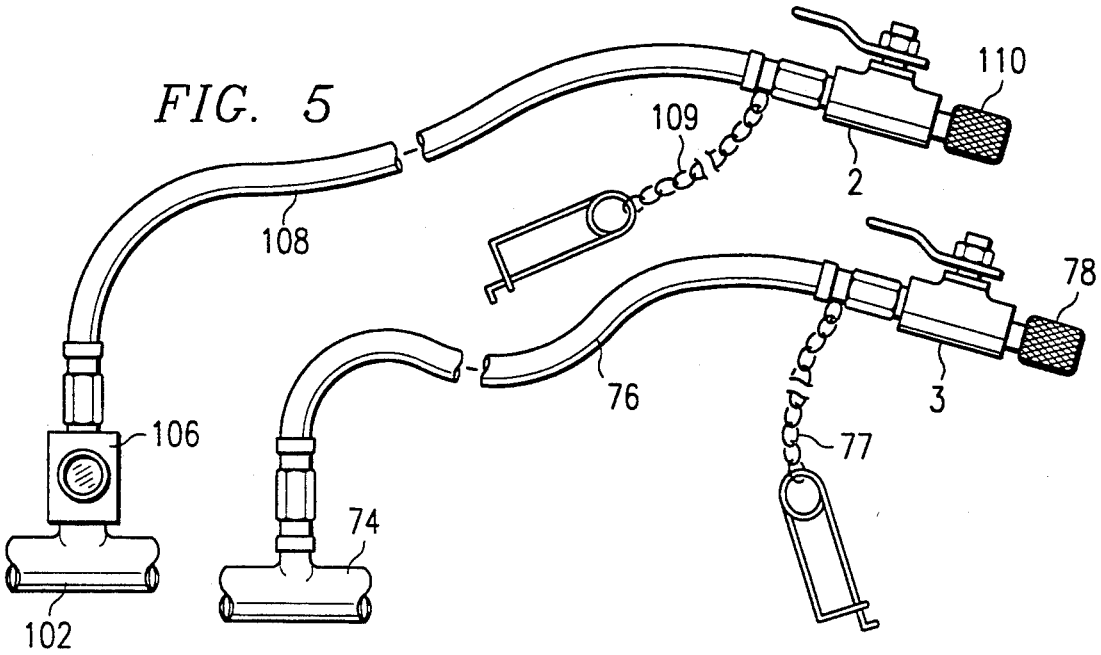
FIG. 5 is a somewhat schematic illustration of the flexible conduits and associated components of the system illustrated in FIG. 4.

The liquid valve 8 of the shipping container 34 is connected by a conventional quick-release coupling 92 to a valve 7 on the end of a flexible conduit 94, which is connected by a valve 5 to a liquid manifold 96. The liquid manifold includes a conduit 98, a liquid sight glass 100, a conduit 102 and conduits 104, for each of the four recovery cylinders, stations Nos. 1–4. stations for the collection cylinders 20. Pressure gauges 112 and 114 are provided to indicate the pressures in the liquid and vapor manifolds respectively. Each of the branches 104 is illustrated in greater detail in FIG. 5 and is connected through a liquid sight glass 106 to a flexible hose 108, and valve 2 and a quick-disconnect coupling 110. A safety chain with clip 109 is provided to connect the hose 108 to the recovery cylinder to prevent the hose from whipping in the event the coupling is accidentally disconnected while the hose is under pressure and valve 2 is open. A U tube interconnect 120 is also provided for each of the stations and includes a pair of threaded elbows 122 and 124 which can be connected to the couplings 78 and 110 respectively in order to conveniently store the flexible hoses in a safe position as well as provide a means for interconnecting the flexible hoses of the vapor and liquid manifolds in a continuous fluid flow path. A pressure gauge 122 is also provided to monitor the pressure in the conduit between the check valves 84 and 86 and the manually operated valve 80 in order to monitor the pressure at the input to the heat exchanger.

Figure 4:
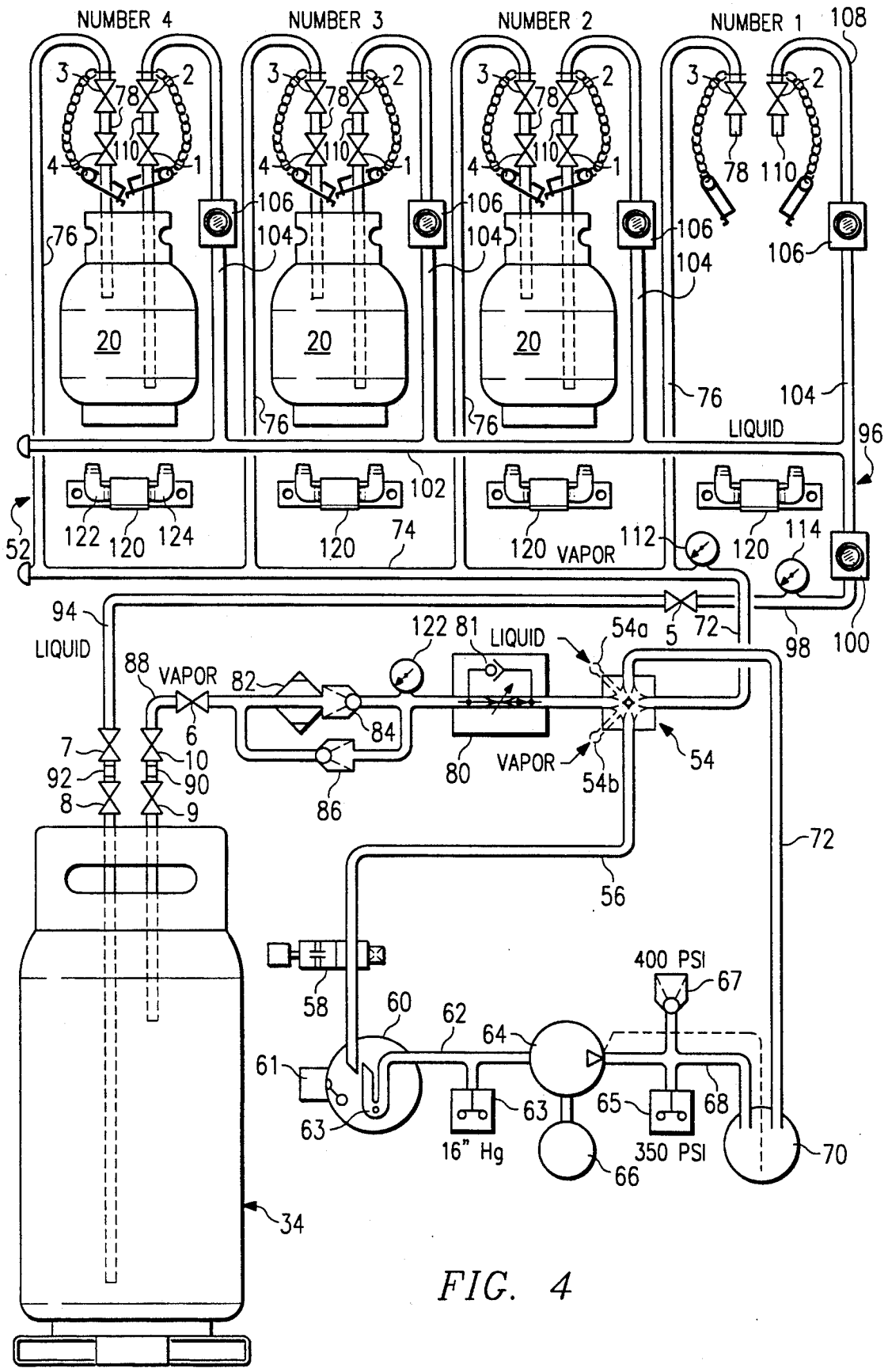
FIG. 4 is a schematic piping diagram of a refrigerant transfer system in accordance with the present invention.
Figure 6:
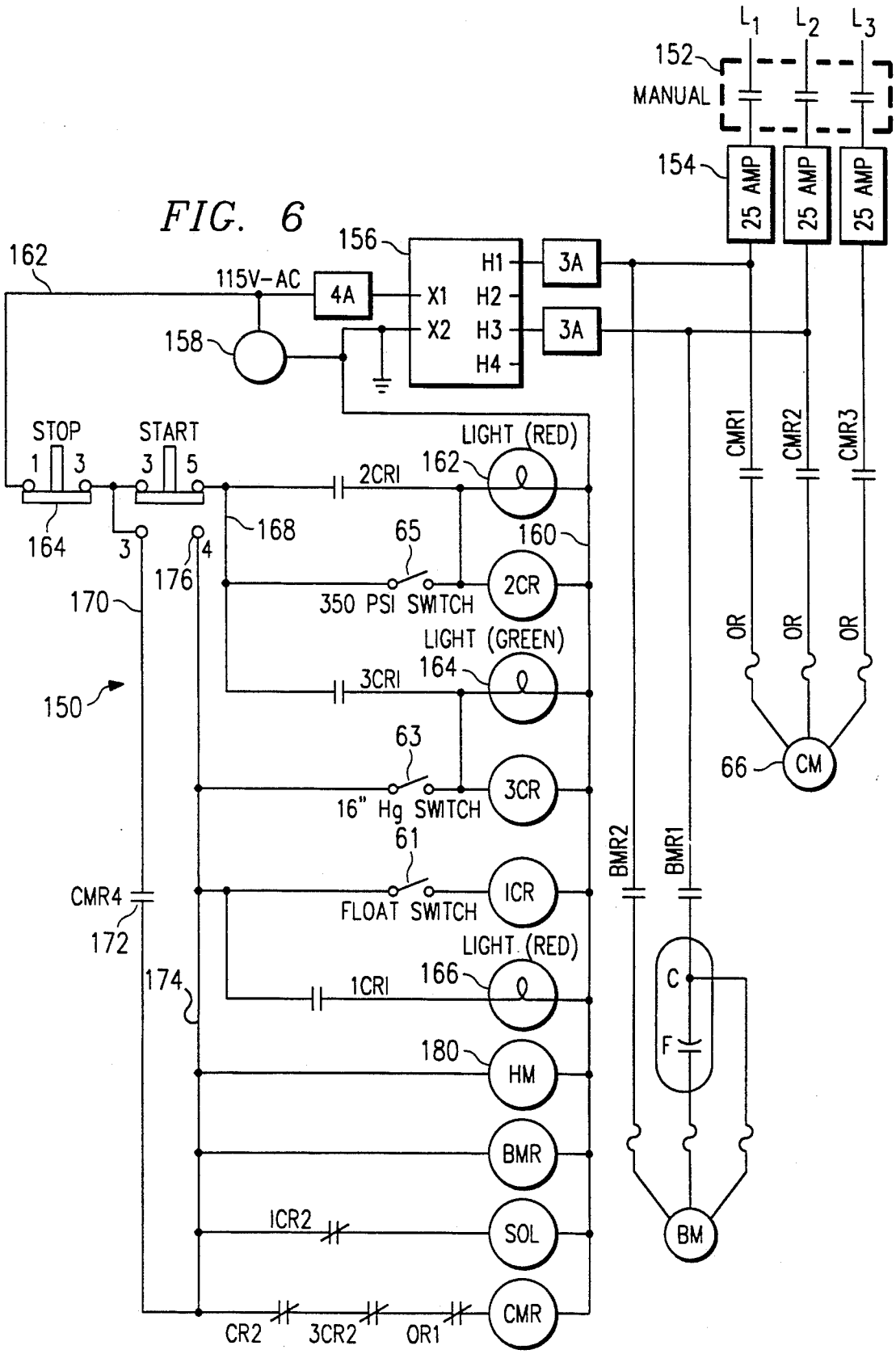
FIG. 6 is a schematic electrical circuit diagram used in conjunction with the system of FIG. 4.

The electrical circuit for controlling the refrigerant system 52 illustrated in FIG. 4 is indicated generally by the reference numeral 150 in FIG. 6. A manual switch 152 connects power through circuit breakers 154 and normally open contacts CMR1, CMR2, and CMR3 to the compressor motor 66. A multi-tap transformer 156 provides 115 volt AC power and to bus 160 and conductor 162 and to a scale weight display represented generally by the reference numeral 158. Conductor 162 is connected through a normally closed "stop" switch and a two position "start" switch to an upper bus 168, and by way of conductor 170 and normally open contacts CMR4 and conductor 172 to a bus 174. The bus 174 is also connected to the normally open contact 176 of the start switch 166.

The conductor 168 connects normally-open contacts 2CR1 which is a holding circuit for a red indicator light 162. When the normally-open contacts 2CR1 close, the relay remains energized to disable the system until the circuit is manually reset before proceeding. The drawdown mercury switch 63 is connected in series with relay 3CR so that when the switch 63 closes, contacts 3CR1 act as a holding switch to keep the relay energized and to illuminate the green indicator light 164. This condition will continue until the start switch opens to allow relay 3CR to drop out holding contacts 3CR1. The float switch 61 is connected in series with relay 1CR so that when it is closed by the liquid and the wet sump reaching a pre-determined level, normally open contacts 1CR1 close to illuminate the red indicator light which stays illuminated only so long as the float switch 61 is closed.

When the start switch is depressed to the normally open position, relay CMR is energized to open contacts CMR1, CMR2 and CMR3 to energize the compressor motor as well as to close the normally open holding contacts CMR4. When the "start" switch is depressed, the heat exchanger blower motor relay BMR is also energized to open contacts BMR1 and BMR2, and also the solenoid of valve 58 through normally closed contacts 1CR2 to open valve 58. Thus, the solenoid valve 58 remains open unless the float switch senses high liquid level and closes switch 61 to open contacts 1CR for fail-safe reasons. An hour meter 180 is energized whenever the system is operating. Normally closed contacts 2CR2, 3CR2 and OR1 are connected in series with compressor motor relay CMR. As a result, the compressor is turned off when overpressure switch 65 closes to energize relay 2CR as a result of an overpressure condition or when the drawn-down switch 63 closes because the pressure is below sixteen inches of mercury and the vapor drawn-down cycle should be terminated, thus energizing relay 3CR to open contact 3CR2. normally-closed relay OR1 responds to thermal overload sensors OR in the power circuit to the compressor motor and terminates operation when an unsafe overload condition exists.

In accordance with the important aspect of the present invention, the system 50 is formed in the configuration illustrated in FIG. 7. Thus, a generally waist-high work bench 200 is supported by a pair of end-legs 202 and 204 which are braced by a removable, modular lower shelf 206. The lower shelf mounts the electric motor 66, compressor 64, heat exchanger 82, and other components included within those two loops of the circuit 52 illustrated in FIG. 4. The work surface of the bench is preferably formed by a rubberized cushion 208 to facilitate handling of the recovery cylinders 20 without damage to the metal table and to reduce noise. A rear panel 210 extends upwardly from the work surface 208 and supports the vapor manifold 74, liquid manifold 98 and the associated components including the sight glasses 106 and flexible hose assemblies 76 and 104. It is important that not only the sight glasses, but all of the plumbing associated with the manifolds be placed in plain view of the operator to facilitate his making the proper connections to the recovery cylinders 20. The manifolds and associated apparatus are protected by guard rails 99 to prevent accidental damage from handling of the cylinders 20.

In addition, valve 54, gauges 112 and 114 and the various control buttons and indicator lights are positioned on the back panel, preferably clustered at one end. A digital readout 212 for the scales (see FIG. 8, for example) which weigh the shipping cylinder 34 are also supported on the rear of the upstanding panel 210. The shipping container 34 is preferably positioned on strain gauge type scales 212 so that it can be determined when the shipping cylinder is full of liquid refrigerant. Flexible hoses 88 and 94 connect the appropriate valves of the shipping cylinder 34 to the vapor manifold and liquid line respectively.

FIGS. 8*a* to 8*d*, 9*a* to 9*h*, and 10*a* to 10*d* serve to explain the operation of the system of the present invention, and to set forth the methods of the present invention which can be carried out in the system to transfer liquid refrigerants from the collection cylinders 20 to the shipping cylinder 34 without loss of refrigerants to the atmosphere, without inclusion of air in the cylinder 34 which would reduce its capacity for shipping as well as contaminate the refrigerant, and to permit different types of refrigerants to be successively transferred without cross-contamination.

Figures 8A, 8B:
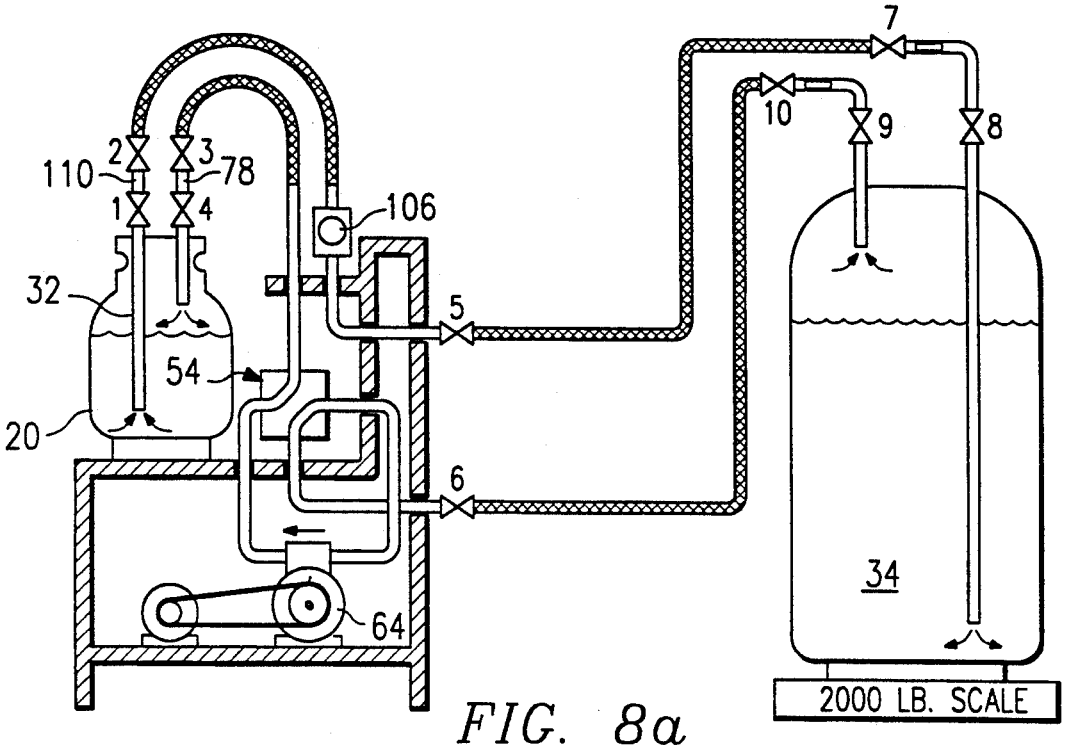
FIGS. 8A and 8D are schematic illustrations of the method of the present invention for transferring liquid and vapor from one cylinder to another in accordance with the present invention, together with instructive notations.
Figures 8C, 8D:
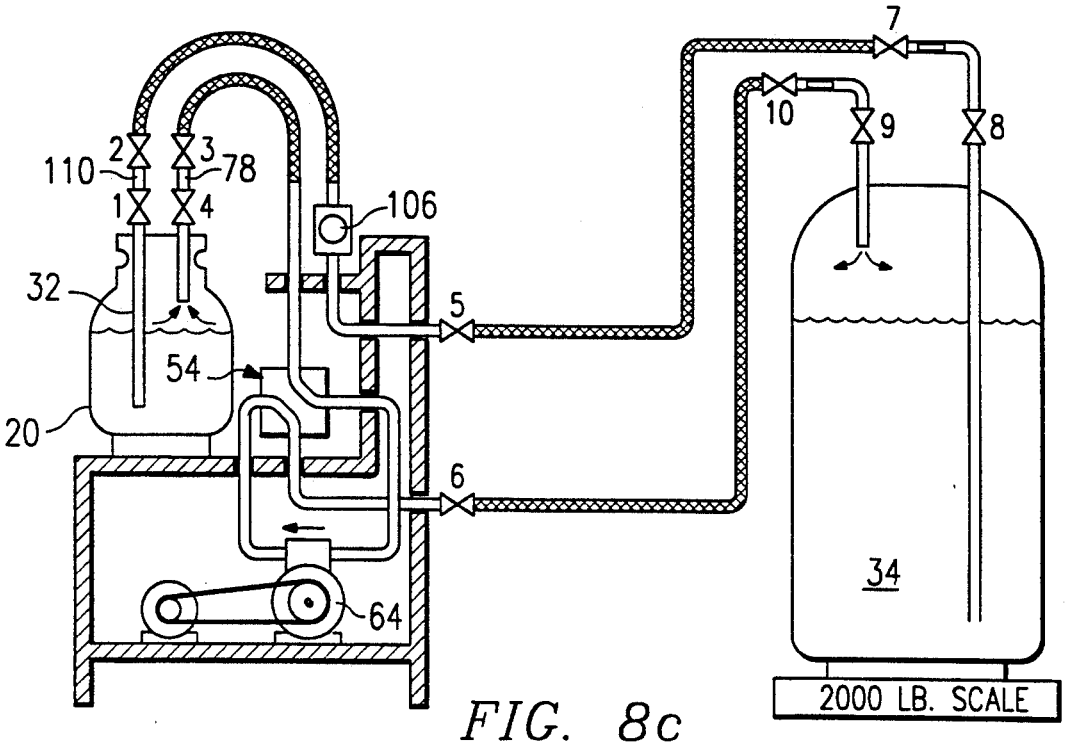

The basic sequence for transferring liquid from the recovery cylinders 20 to the shipping cylinders 34 is illustrated in FIG. 8*a* and 8*d*. As noted from the chart 250 showing the positions of the valves 1–10, see FIG. 8*b*, at the beginning of this operation, all of the valves 1 through 10 are in the open position and the flow directing valve is positioned as illustrated, which is termed the liquid position because it results in the transfer of liquid. When the start switch is depressed, the compressor circulates vapor from the upper portion of the shipping cylinder 34 through valves 9, 10, 6 and 54 to the intake of the compressor 64, and from the output of the compressor through the valve 54, valves 3 and 4 into the upper portion of all recovery cylinders 20. This added pressure then forces the liquid in the recovery cylinders out through the stand pipe 32 and through valve 1, the liquid flow sight glass 106, valves 5, 7 and 8 and into the shipping container 34. Liquid can be transferred from all of the recovery cylinders 20 connected to the manifold substantially simultaneously. By observing the individual sight glasses 106, it can be determined when liquid is no longer being pumped from a particular recovery cylinder 20, at which time valve 2 of the respective recovery cylinders is closed. When valve 2 at all stations have been closed, and the vacuum pump still running, the flow directing valve 54 is shifted to the vapor position illustrated in FIG. 8*c*. As a result, the compressor 64 is then connected through the flow directing valve 54 to the open valves 3 and 4, and thus to the upper portion of the recovery cylinders 20. It will be noted that valve 1 is still open at this time so that all vapors within the system up to valve 2, which is closed, will be drawn down. The output from the compressor is connected through valves 6, 10 and 9 to the pump vapor into the upper portion of the shipping cylinder 34.

This operation continues until such time as the pressure switch 63 determines that the pressure at the input to the compressor is less than 16′ of mercury, at which time switch 63 closes to energize relay 3CR (See FIG. 6) to close contacts 3CR1 and illuminate the green indicator light 164, which indicates that the process is complete, and open contacts 3CR2 to de-energize relay CMR and turn the compressor off. At that time, valves 1, 3 and 4 are closed for all of the recovery cylinders 20. At this point, it will be appreciated that any residual refrigerant liquid which might have remained in the recovery cylinders 20 has been vaporized and substantially removed. The important feature of this portion of the operation is that the only portion of the system that is vented to the atmosphere when the couplings 110 and 78 are disconnected is the very small volume of very low pressure refrigerant within in the couplings between the valves 1 and 2 and between valves 3 and 4. This procedure is then repeated so long as there are recovery cylinders from which the liquid refrigerant needs to be transferred to the shipping cylinder 34.

In normal operation of the system, it is possible through condensation, entrainment, or improper operation for liquids to be caught in the wet sump 60. Introduction of liquid to the compressor 64 is an extremely serious problem and must be avoided. Thus, if liquid at any time rises in the wet sump 60 to the point that float switch 61 is closed, solenoid 1CR is activated which opens the normally closed contact 1CR2, de-energizing relay 1CR and thus allowing solenoid valve 58 to assume its normally closed position to prevent any further transfer of liquid or vapor to the wet sump 60. The compressor continues to run so that as vapor is drawn from the wet sump, the pressure will be reduced and the refrigerant in the wet sump will be vaporized and removed. Small quantities of liquids in the bottom of the wet sump can be entrained through a small orifice 59 in the lower end of the illustrated U-tube since small quantities of liquid along with vapor or other gases does not cause a problem for the compressor.

The compressor 64 has an output capacity which can put pressure into a selected small number of the recovery cylinders at an excess rate. For this reason, a manually operable flow control valve 80 is used to throttle the vapor input to the compressor, and thus the volume output of the compressor. During the liquid transfer mode, vapor is withdrawn from the top of the cylinder 34 through valves 9, 10 and 6, and then through check valve 86 to the flow control valve 80, then through valve 54 to the intake to the compressor. The operator makes this adjustment by observing the pressure displayed by gauge 112 on the vapor manifold.

The compressor 64 is preferably of the type which uses oil or other lubricant as a piston seal, resulting in oil being entrained in the refrigerant vapors. The oil separator 70 collects lubricants from the compressor 64 which are entrained in the vapors and returns the lubricants to the compressor by means of a tube extending into the bottom of the separator 70, as represented by dotted line 71.

During the vapor draw-down mode illustrated in FIG. 8*c*, vapor by-passes the restrictive orifice of the throttling valve 80 by way of the check valve 81 and by way of check valve 84 passes through the heat exchanger 82. The heat exchanger 82 is required in order to insure that the temperature of the refrigerant in the shipping cylinder 34 is low enough to condense the vapor being pumped by the condenser. Not only is the process inefficient and time consuming, but without the heat exchanger, there are instances when the maximum pressure backed up to the output of the compressor will exceed the pressure limits established by the switch 65 and relief valve 67, causing operation of the system to be terminated.

Figures 9A, 9B:
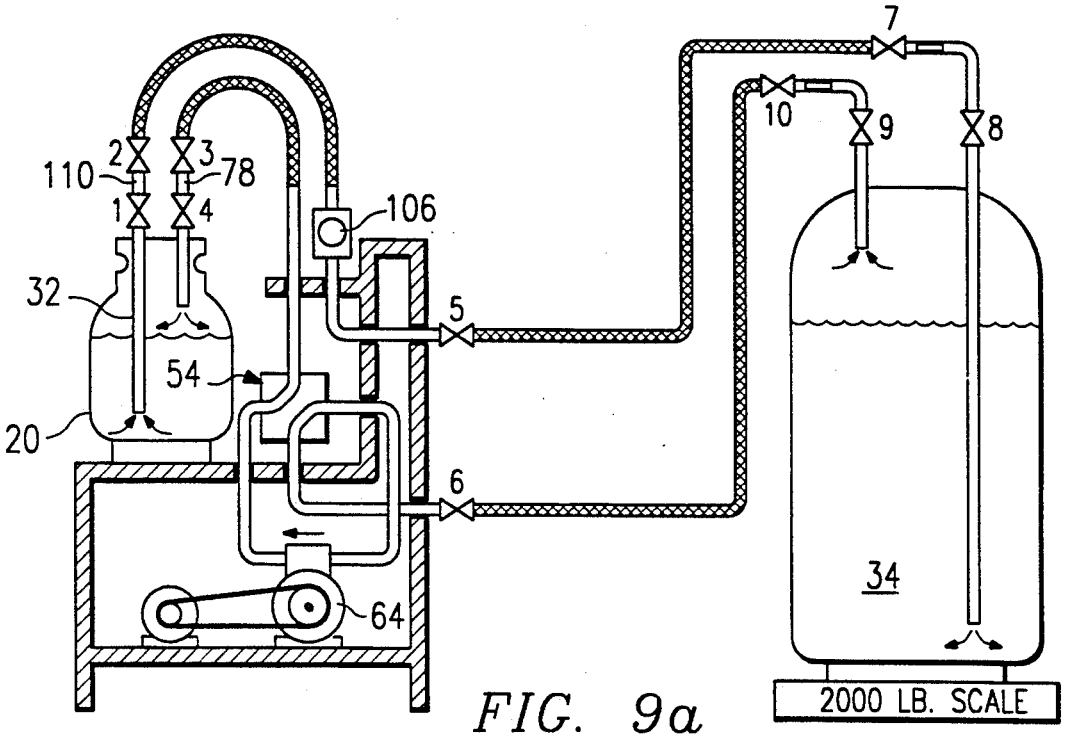
FIGS. 9A–9H are schematic illustrations which serve to illustrate the method of the present invention for controlling refrigerant loss from the system of FIG. 7 at the time a shipping or recovery cylinder is removed from the system.
Figures 9C, 9D:
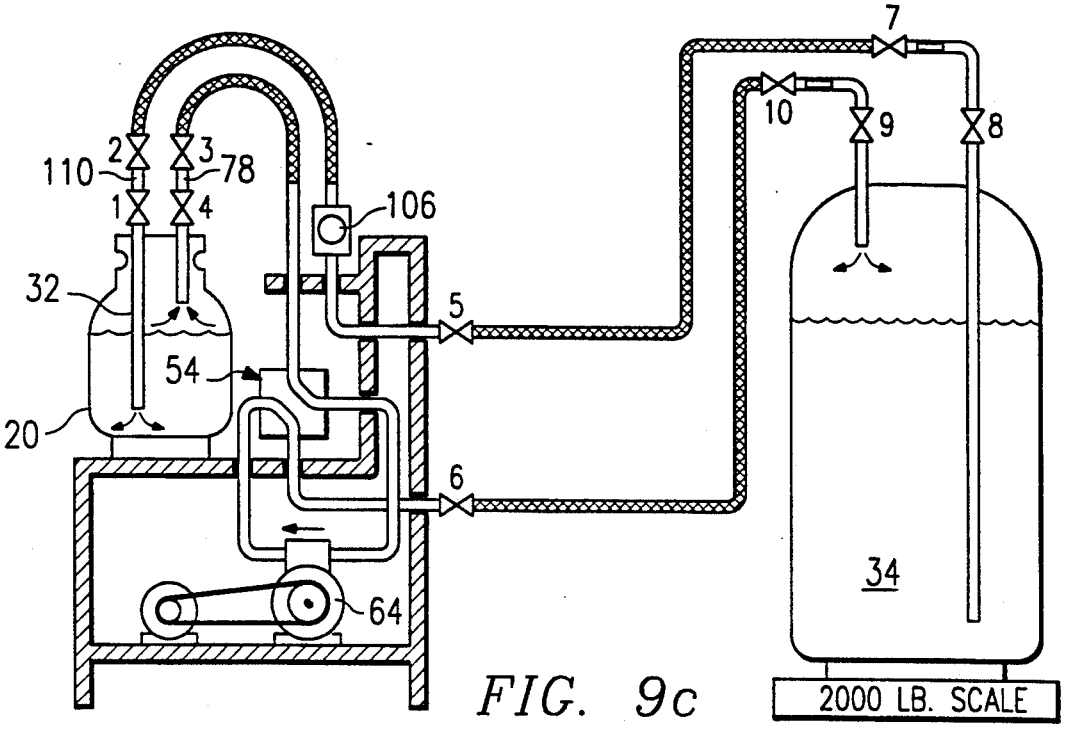
Figures 9E, 9F:
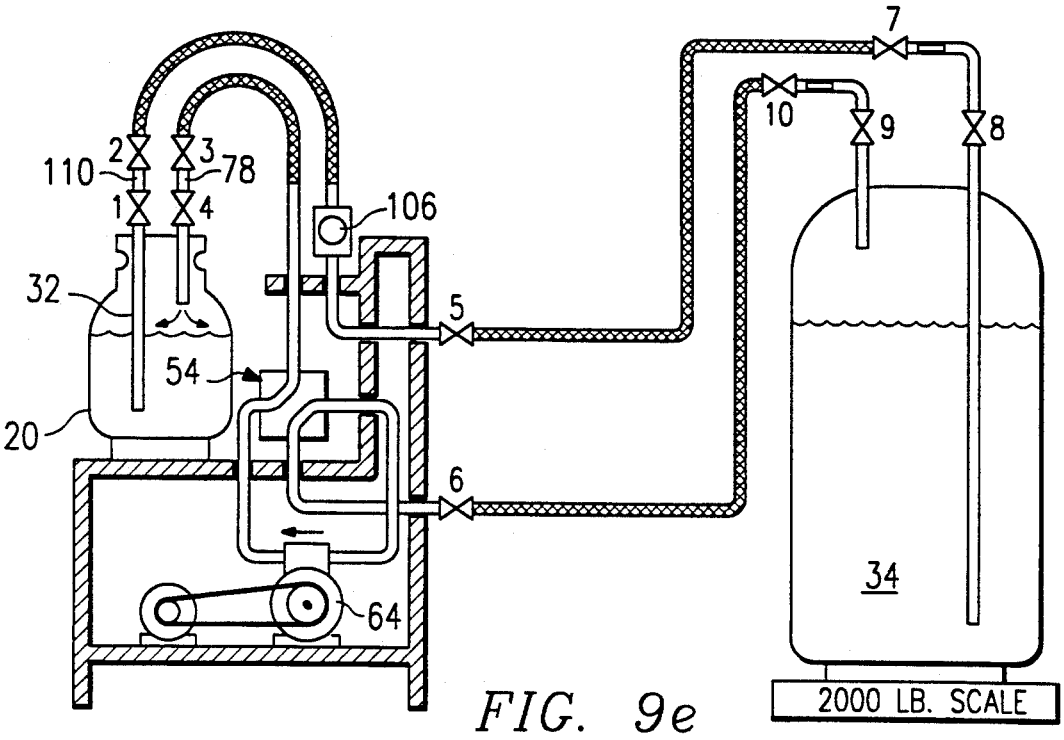
Figures 9G, 9H:
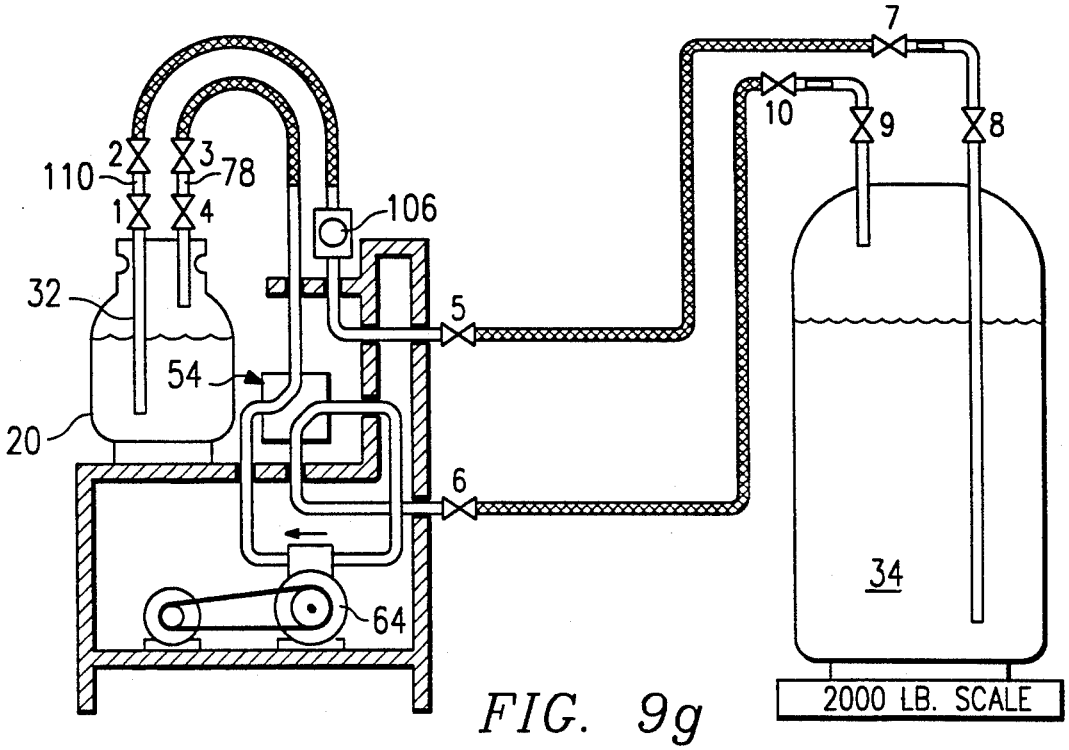

FIGS. 9*a* to 9*h* disclose the method for operating the system in accordance with the present invention so as to control product loss during system shut down, or for the removal or change-out of the shipping cylinder 34. In order to carry out this process, it is necessary to have four recovery cylinders 20 which are dedicated to each particular type of refrigerant being processed in order to prevent cross contamination of refrigerants. At the termination of any transfer of liquid from the recovery cylinders 20 to the shipping cylinders 34, the liquid line extending from valve 2 to the shipping cylinder 34 is completely full of liquid because of the vapor pressure in the cylinder. Thus, in order to remove the shipping cylinder without loss of significant quantities of refrigerant to the atmosphere, it is necessary to purge the system of refrigerants to the extent possible. It is also desirable to purge the system of the refrigerant so that a different refrigerant can be processed if desired. Thus, before the filled shipping cylinder 34 is removed, the four dedicated recovery cylinders are attached and all valves opened except valve 1, as indicated in FIGS. 9*a* and 9*b*. Flow directing valve 54 is then cycled from vapor to liquid positions to balance the pressures in the system. Then valve 1 is also opened and the compressor is operated to be sure that all liquid in the liquid manifold and line is removed, as well as any excess liquid in the recovery cylinders 20. Valve 8 is then closed and the flow directing valve 54 is rotated to the vapor position to begin pumping the vapor in the liquid line and in the recovery cylinders 20 to the shipping cylinder 54. The procedure continues as illustrated in FIGS. 9*c* and 9*d* until the pressure switch 63 determines that the pressure at the input is at least less than 16" of mercury, at which time valves 1, 2 and 3 at the recovery cylinders 20, and valve 9 at the shipping cylinder 34 are closed. The procedure continues as illustrated in FIGS. 9*e* and 9*f* by sequentially equalizing the pressure within the system by opening one of the recovery cylinders at a time to the system. This is accomplished by opening valve 3 at the respective recovery cylinder 20 so that the pressure will equalize, which can be monitored by observing the vapor manifold pressure gauge, at which time valves 3 and 4 for the respective recovery cylinder are closed. By this sequential equalization of pressure, the vapor manifold pressure can be drawn down as low as 5–10 inches mercury. After this procedure is completed, the dedicated recovery cylinders can be marked and set aside for repeated use with the same particular refrigerant product without the possibility of cross contamination. In order to attach a new shipping cylinder to the system, all valves in the system are closed, except for valves 5 and 6, as illustrated in FIGS. 9*g* and 9*h*. After the shipping cylinder is attached by the couplings to valves 7 and 10, valves 8 and 9 are opened to check for leaks at the couplings. Valves 7 and 10 are then opened so that the shipping cylinder is in fluid communication with both the liquid and vapor lines, and flow directing valve 54 is cycled to balance all pressures. The system is then ready for normal operation.

Figures 10A, 10B:
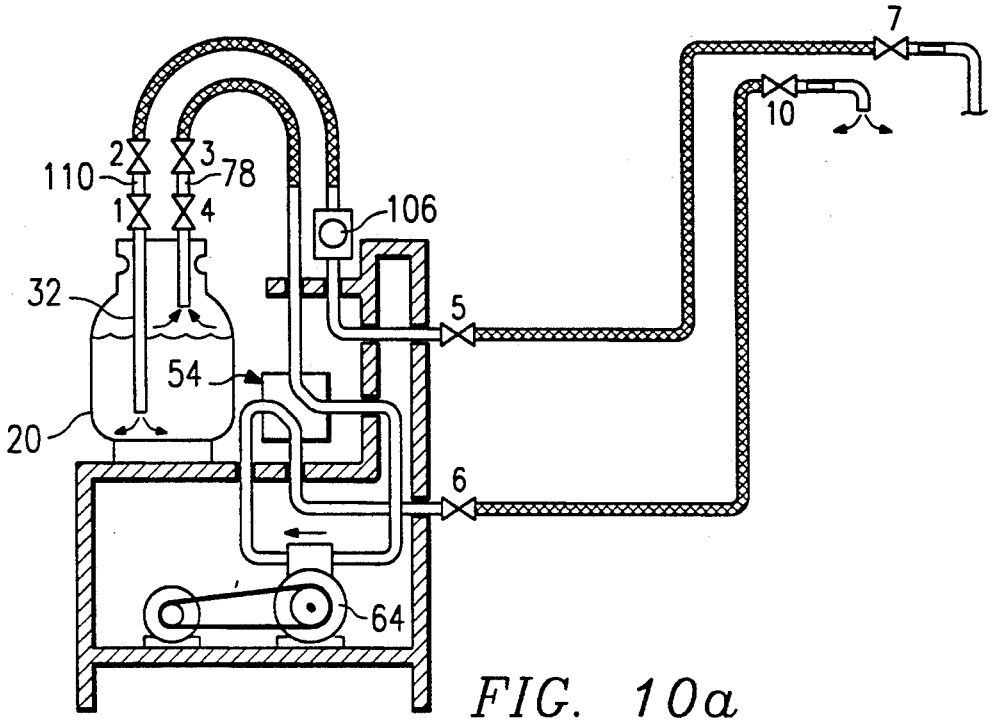
FIGS. 10A and 10D illustrate the method of the present invention for minimizing air inclusion in the system of FIG. 7 at start up or when a cylinder is detached, and the system has been vented to atmosphere.

There are occasions when the system may have included air as a result of being vented to the atmosphere. In this situation, it is desirable to substantially eliminate the air from the system before proceeding with normal operational use. The procedures illustrated in FIGS. 10*a* to 10*d* use the compressor of the system for this purpose, rather than the alternative method of using a separate vacuum pump. Thus, as illustrated in FIGS. 10*a* and 10*b*, four empty recovery cylinders 20 are attached to the manifold. It is assumed that these recovery cylinders are filled with air. All valves are in the open position except for valve 7, and the compressor is started in order to evacuate the line extending from the input to the compressor through the vacuum manifold and liquid manifold back to valve 7 and pump the air out through open valve 10. The system automatically stops when the pressure reaches 16" of mercury. Manual start/stop overrides can be used if it is desired to lower the pressure further and thus evacuate a greater portion of the air. Next, valves 1, 2 and 3 of each recovery cylinder are closed to isolate the low pressure in the respective recovery cylinders 20.

Figures 10C, 10D:
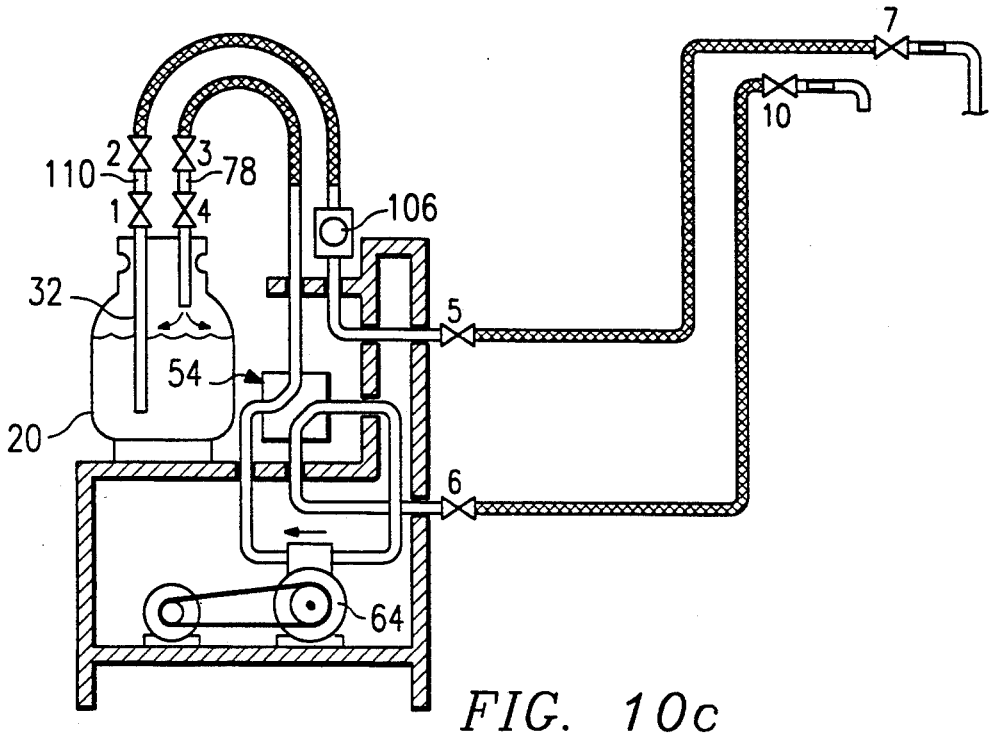

At the conclusion of the procedure shown in FIGS. 10*a* and 10*b*, the line from the vapor pump through open valve 10 is filled with air. Accordingly, as illustrated in FIGS. 10*c* and 10*d*, valve 10 is closed to isolate the entire system from the atmosphere, and then the flow directing valve is switched and valve 3 of one recovery cylinder is opened until pressure is balanced. Then valves 3 and 4 are closed to repeat this sequence at all cylinders, so that by sequentially equalizing the relatively large volume of the recovery cylinders 20 with the relatively smaller volume of the system causes the pressure in the system to be reduced to the desired low pressure level.

From the above detailed description of the various aspects of the invention, it will be evident that method and apparatus has been described which effectively and efficiently can transfer refrigerants or other similar two-phase products from a plurality of relatively small recovery cylinders to a significantly larger shipping cylinder. The system makes it practical to reclaim used refrigerant from a wide geographical area and ship it to a reprocessing facility. This is achieved with no loss of the refrigerant to the atmosphere, and thus no loss of the valuable refrigerant fluid. The system can be used to handle different types of refrigerants without cross contamination. The system has a significant measure of automation, and is protected against malfunctions. The system is relatively user friendly, considering the complexity inherent in handling a two-phase fluid which is above atmospheric pressure at normal ambient temperatures.

In summary, FIGS. 8*a* and 8*b* illustrate operation "A" of transferring liquid from the recovery cylinder to the shipping cylinder. First, the flow valve is cycled from the liquid to the vapor position to balance the manifold gages. Next, attach the recovery cylinders to the manifold and set the valves as in chart. Next, start the compressor and observe each liquid flow sight. The cylinders alternately pump empty liquid from about 4 to 6 minutes. Pumping is complete when respective cylinder flow sight glass appears dry. Close valve 2 of each cylinder as it pumps dry. Note, pump all liquid from the cylinders. Excess residual liquid may not vaporize under vacuum drawdown. Last, with valve 2 closed all stations and with compressor running, shift flow valve to vapor position to begin vapor drawdown-operation "B".

FIGS. 8*c* and 8*d* illustrate operation "B", vapor draw-down, of the transferring liquid from the recovery cylinder to the shipping cylinder. This operation requires about 12 to 15 minutes. The compressor automatically shuts down at the end of cycle. After shutdown close valves 1,3 and 4. Detach and remove cylinders from bench. Note, the compressor automatically stops when the vacuum reaches 16"Hg pressure. This procedure is repeated so long as there are recovery cylinders with liquid refrigerant to be emptied.

FIGS. 9*a* and 9*b* illustrate the first step of controlling product loss during system shut down. First, attach four each empty product dedicated 47.7 lb. water capacity cylinders. Set valves as noted and cycle the flow valve from the vapor to the liquid position to balance pressure gages. Next, open valve 1 and operate compressor 3 to 5 minutes and close valve 8 with compressor running. Note, to aid complete vapor drawdown pump all liquid possible. Observe the manifold liquid flow sight to visually determine conditions. With the compressor running, rotate the flow valve to the "vapor" position and begin liquid system vapor drawdown-operation 2. FIGS. 9*c* and 9*d* illustrate the next operation in controlling product loss. This operation requires 12 to 15 minutes. The compressor automatically shuts down at the end of cycle. After shutdown, close valves 1, 2, 3 and 9.

FIGS. 9*e* and 9*f* illustrate the third operation in controlling product loss. First, open valve 3 on one cylinder only. Close valves 3 and 4 after the vapor manifold gage ceases to indicate continued lowering of pressure. Repeat this cycle with all cylinders, then close valve 10. Note, after sequencing all cylinders for drawdown, vapor manifold pressure will be 5" to 10" Hg. Caution should be exercised because simultaneous venting of all cylinders for drawdown gives less than equal results to sequential drawdown. Dedicated product recovery cylinders used for this operation will likely be at positive pressure condition. Mark and set aside for repeated use.

FIGS. 9*g* and 9*h* illustrate the final operation in controlling product loss during shutdown. First, mount cylinder on scales, attach transfer hose, open vapor valve 9 and liquid valve 8. Check for leaks. Open valves 7 and 10-cycle flow valve from liquid to vapor to balance all pressure gages. Caution should be exercised because, the shipping cylinders have both liquid and vapor valves at each valve position (8 and 9). Opening liquid valve at 9 floods the compressor wet slump and closes the intake shut-off valve up-stream sump. Should this occur close liquid and open vapor at 9. Set system valves as in operation 1 and run compressor to vaporize liquid. Return to normal operation.

FIGS. 10*a* and 10*b* illustrate the operation of eliminating any air trapped in the system. First, set valves as noted and attach four 50 pound empty recovery cylinders to the manifold. Start the compressor and draw liquid manifold down to 10/15" Hg minimum. Close valves 1, 2 and 3. This operation requires about five minutes. Note, the compressor automatically stops when vacuum reaches 16" hg. Manual start/stop overrides. Next, referring now to FIGS. 10*c* and 10*d*, the valves should be set as shown. Open valve 3 at one work station and allow pressure to stabilize. Close valves 3 and 4. Repeat this at all stations. Note, where total machine drawdown is required, attach a low volume pump at valve 3. Open valves 3 and 5 and pump down auxiliary vapor line and vapor manifold to minimum 15" Hg. Shipping cylinders may now be attached per procedure 4.

Alternatively to the procedure described above, one can utilize a low volume vacuum pump as follows. First, attach the pump to the vapor hose at any work station. Set system as noted and additionally close valve 10. Operate the vacuum pump and cycle flow directing valve to both liquid and vapor positions.

Although preferred embodiments of the method and apparatus of the present invention have been described in detail, it is to be understood that various changes, substitutions and alterations can be made therein without departing from the spirit and scope of the invention as defined by the appended claims.

What is claimed is:

1. A system for transferring a refrigerant between a pressurized recovery cylinder and a pressurized shipping cylinder, the combination comprising:

a recovery cylinder having associated therewith a vapor valve having an inlet connected to and in communication with the upper interior portion of a recovery cylinder and an outlet, and a liquid valve having an inlet connected to and in communication with the lower interior portion of the recovery cylinder and an outlet;

a shipping cylinder having associated therewith a vapor valve having an inlet connected to and in communication with the upper interior portion of the shipping cylinder and an outlet, and a liquid valve having an inlet adapted to be connected to and in communication with the lower interior portion of the shipping cylinder and an outlet;

a vapor system for placing the vapor valve of the recovery cylinder in fluid communication with the vapor valve of the shipping cylinder, the vapor system including a flexible hose having a coupling at one end thereof with an inlet connected directly to the outlet of each of the vapor valves and having a valve being independently operable with respect to the operation of the coupling, disposed in close proximity to each coupling;

a liquid system for placing the liquid valve of the recovery cylinder in fluid communication with the liquid valve of the shipping cylinder, the liquid system including a flexible hose having a coupling at one end thereof with an inlet connected directly to the outlet of each of the liquid valves and having a valve being independently operable with respect to the operation of the coupling disposed in close proximity to each coupling; and, vapor pumps means included in the vapor system for selectively pumping vapor from the shipping cylinder to the recovery cylinder, or in the alternative, from the recovery cylinder to the shipping cylinder.

2. The system of claim 1 wherein:

the vapor system includes vapor manifold means having a plurality of stations each for receiving a recovery cylinder, each station including a flexible hose, valve and coupling for connection to the vapor valve of the respective recovery cylinder, and the liquid system includes liquid manifold means having a plurality of stations each for receiving a recovery cylinder, each station including a flexible hose, valve and coupling for connection to the liquid valve of the respective recovery cylinder.

3. The system of claim 2 wherein the vapor system includes means for cooling vapor before it is pumped into the shipping cylinder.

4. The system of claim 2 wherein each station includes means for determining whether liquid or vapor is flowing from the respective recovery cylinder.

5. The system of claim 2 wherein each station includes a position on a work surface disposed on a work bench at a convenient intermediate height to a typical workperson, and the manifold means are mounted on a panel behind and above the work surface.

6. The system of claim 5 wherein the work bench includes a shelf disposed below the work surface and at least the vapor compressor means is mounted on the shelf.

7. The system of claim 1 wherein the vapor pump means includes a vapor compressor and valve means for selectively pumping vapor from the shipping cylinder to the recovery cylinder, or in the alternative, from the recovery cylinder to the shipping cylinder.

8. The system of claim 7 wherein the vapor pump includes means for selectively controlling the volumetric flow of vapor to the compressor to thereby control the volumetric flow of vapor from the compressor.

9. The system of claim 7 wherein the vapor pump means includes means for preventing the flow of a liquid refrigerant into the intake of the compressor.

10. The system of claim 9 wherein the means for preventing the flow of liquid into the intake of the compressor includes a wet sump for collecting liquid and means responsive to a predetermined collection of liquid for terminating the flow of fluid to the wet sump.

11. The system of claim 7 wherein the vapor pump means includes means for sensing the vapor pressure at the input of the compressor and for automatically terminating operation of the compressor when the vapor pressure is below a predetermined value indicative of the fact that all liquid has been exhausted from the portion of the vapor system to which the input is in fluid communication.

12. The system of claim 7 wherein the vapor pump means includes oil separator means for receiving vapors output from the compressor and separating the lubricating oils therefrom and returning the lubrication oils to the compressor.

13. A system for transferring a refrigerant between a pressurized recovery cylinder and a pressurized shipping cylinder, the combination comprising:

a recovery cylinder having associated therewith a vapor valve having an inlet connected to and in communication with the upper interior portion of a recovery cylinder and an outlet and a liquid valve having an inlet connected to and in communication with the lower interior portion of the recovery cylinder and an outlet;

a shipping cylinder having associated therewith a vapor valve having an inlet connected to and in communication with the upper interior portion of the shipping cylinder and an outlet and a liquid valve having an inlet adapted to be connected to and in communication with the lower interior portion of the shipping cylinder and an outlet;

a vapor system for placing the vapor valve of the recovery cylinder in fluid communication with the vapor valve of the shipping cylinder, the vapor system including a flexible hose having a coupling at one end thereof with an inlet connected directly to the outlet of each of the vapor valves and having a valve being independently operable with respect to the operation of the coupling disposed in close proximity to the coupling;

a liquid system for placing the liquid valve of the recovery cylinder in fluid communication with the liquid valve of the shipping cylinder, the liquid system including a flexible hose having a coupling at one end thereof with an inlet connected directly to the outlet of each of the liquid valves and having a valve being independently operable with respect to the operation of the coupling disposed in close proximity to the coupling;

a vapor compressor having an input and an output;

flow directing valve means having first, second, third and fourth ports;

first line means connecting the first port to the input of the compressor;

second line means connecting the second port to the output of the compressor;

third line means connecting the vapor valve of the shipping cylinder to the third port;

vapor manifold means connecting the fourth port to the vapor valve of the recovery cylinder;

the flow directing valve means including means for selectively placing the first and third ports in fluid communication and the second and fourth ports in fluid communication, and in the alternative, placing the first and fourth ports in fluid communication and the second and third ports in fluid communication.

14. The method for transferring liquid refrigerant between a pressurized recovery cylinder and a pressurized shipping cylinder, comprising the steps of:

providing a recovery cylinder having associated therewith a vapor valve having an inlet connected to and in communication with the upper interior portion of a recovery cylinder and an outlet, and a liquid valve having an inlet connected to and in communication with the lower interior portion of the recovery cylinder and an outlet;

providing a shipping cylinder having associated therewith a vapor valve having an inlet connected to and in communication with the upper interior portion of a shipping cylinder and an outlet, and a liquid valve having an inlet connected to and in communication with the lower interior portion of the shipping cylinder and an outlet;

connecting a vapor system to the vapor valve of each of the cylinders by means of a coupling having at one end thereof an inlet connected directly to the outlet of each vapor valve to establish fluid communication therebetween, the vapor system including a system vapor valve being independently operable with respect to the operation of the coupling adjacent each of the couplings and vapor pump means for selectively pumping vapor from the shipping cylinder to the recovery cylinder, or in the alternative, from the recovery cylinder to the shipping cylinder;

connecting a liquid system to the liquid valve of each of the cylinders by a coupling having at one end thereof an inlet connected directly to the outlet of each vapor valve to establish fluid communication therebetween, the liquid system including a liquid system valve being independently operable with respect to the operation of the coupling adjacent each of the couplings;

opening the vapor valves and liquid valves on both cylinders and the system vapor valves and system liquid valves at both cylinders;

operating the vapor pump means to pump vapor from the shipping cylinder to the recovery cylinder until all liquid refrigerant is transferred by the resulting pressure in the recovery cylinder to the shipping cylinder through the liquid system, closing the system vapor valve and liquid valve adjacent the coupling to the recovery cylinder vapor valve and closing the vapor valve and liquid valve of the recovery cylinder, and disconnecting the couplings to the recovery cylinder whereby only the low pressure vapor within the coupling between the valves on the recovery cylinder and the system valves adjacent the couplings will be lost to the atmosphere and only air then filling the couplings will be included in a shipping cylinder when liquid is transferred from the next recovery cylinder attached to the coupling.

15. In the method for transferring liquid refrigerant between a pressurized recovery cylinder and a pressurized shipping cylinder, comprising the steps of:

providing a recovery cylinder having associated therewith a vapor valve having an inlet connected to and in communication with the upper interior portion of a recovery cylinder and an outlet, and a liquid valve having an inlet connected to and in communication with the lower interior portion of the recovery cylinder and an outlet;

providing a shipping cylinder having associated therewith a vapor valve having an inlet connected to and in communication with the upper interior portion of a shipping cylinder and an outlet, and a liquid valve having an inlet connected to and in communication with the lower interior portion of the shipping cylinder and an outlet;

connecting a vapor system to the vapor valve of each of the cylinders by means of a coupling having at one end thereof an inlet connected directly to the outlet of each vapor valve, to establish fluid communication therebetween, the vapor system including a system vapor valve being independently operable with respect to the operation of the coupling; adjacent each of the couplings and vapor pump means for selectively pumping vapor from the shipping cylinder to the recovery cylinder, or in the alternative, from the recovery cylinder to the shipping cylinder, connecting a liquid system to the liquid valve of each of the cylinders by means of a coupling having at one end thereof an inlet connected directly to the outlet of each vapor valve to establish fluid communication therebetween, the liquid system including a liquid system valve being independently operable with respect to the operation of the coupling adjacent each of the couplings, establishing fluid communication between the vapor system and liquid system through the system vapor valve and the system liquid valve adjacent the couplings to a recovery cylinder operating the vapor and liquid systems to pump vapor from the shipping cylinder through the vapor and liquid systems back to the shipping cylinder liquid valve and into the shipping cylinder to purge all liquid from the liquid system, closing the liquid valve of the shipping cylinder;

operating the vapor pumping means to pump vapor from the liquid system through the vapor system and though the vapor valve of the shipping cylinder until the vapor pressure in the liquid system is below a predetermined minimum;

closing the system liquid valve adjacent the shipping cylinder, and closing the vapor valve of the shipping cylinder;

operating the vapor pumping means to pump vapor from the coupling to the shipping cylinder vapor valve until the vapor pressure at the intake of the vapor pumping means is below a predetermined minimum;

closing the system vapor valve adjacent the shipping cylinder; and disconnecting the coupling means to the shipping cylinder whereby only the vapor within the coupling means will be vented to the atmosphere.

16. In the method for transferring liquid refrigerant between a plurality of pressurized recovery cylinders and a pressurized shipping cylinders, comprising the steps of:

providing a plurality of recovery cylinders with each of the recovery cylinders having associated therewith a vapor valve having an inlet connected to and in communication with the upper interior portion of each recovery cylinder having an outlet and a liquid valve having an inlet connected to and in communication with the lower interior portion of each recovery cylinder and an outlet;

providing a shipping cylinder having associated therewith a vapor valve having an inlet adapted to be connected to and in communication with the upper interior portion of the shipping cylinder and an outlet, and a liquid valve having an inlet adapted to be connected to and in communication with the lower interior portion of the shipping cylinder and an outlet;

providing a vapor system for connection to the vapor valves of each of the cylinders including vapor pump means for selectively pumping vapor from the shipping cylinder to the recovery cylinder, or in the alternative, from the recovery cylinder to the shipping cylinder, the vapor system including couplings for connection to each of the vapor valves of the cylinders and system vapor valves being independently operable with respect to the operation of the coupling adjacent each of the couplings connecting the vapor system to the respective vapor valves of the cylinders;

providing a liquid system for connection to the liquid valves of each of the cylinders for establishing fluid communication therebetween, the liquid system including couplings for connecting the liquid system to the respective liquid valves and system liquid valves being independently operable with respect to the operation of the coupling adjacent each of the couplings, connecting a plurality of recovery cylinders to the vapor system and to the liquid system by means of the couplings having at one end thereof an inlet connected directly to the outlets of each vapor and liquid valve;

connecting a shipping cylinder to the vapor system and to the liquid system by means of the couplings having at one end thereof an inlet connected directly to the outlets of each vapor and liquid valve;

opening all valves in the vapor and liquid systems and on the cylinders;

operating the vapor pump means to selectively pump vapor from the shipping cylinder to the vapor cylinder until all liquid is forced from the liquid system into the shipping cylinder;

closing the liquid valve of the shipping cylinder;

operating the vapor pump means to selectively pump vapor from the recovery cylinder to the shipping cylinder until the vapor pressure at the intake of the vapor pump is below a predetermined value;

closing all liquid valves and the vapor valves of all of the recover cylinders and the vapor valve of the shipping cylinder;

progressively reducing the pressure in the vapor system, comprising the steps of: opening the vapor valve of one recovery cylinder until the pressure equalizes with the pressure in the vapor system with the pressure in the recovery cylinder; closing the vapor valve and then sequentially repeating these steps for all other recovery cylinders; and closing the remainder of the valves before disconnecting the couplings from the recovery cylinders.

17. In the method for purging air from a system capable of transferring liquid refrigerant between a plurality of pressurized recovery cylinders and a pressurized shipping cylinder, comprising the steps of:

providing a plurality of recovery cylinders with each of the recovery cylinders having associated therewith a vapor valve having an inlet adapted to be connected to and in communication with the upper interior portion of each recovery cylinder and an outlet, and a liquid valve having an inlet adapted to be connected to and in communication with the lower interior portion of each recovery cylinder and an outlet;

providing a shipping cylinder having associated therewith a vapor valve having an inlet connected to and in communication with the upper interior portion of the shipping cylinder and an outlet, and a liquid valve having an inlet adapted to be connected to and in communication with the lower interior portion of the shipping cylinder and an outlet, said vapor system containing air;

providing a vapor system for connection to the vapor valves of each of the cylinders including vapor pump means for selectively pumping vapor from the shipping cylinder to the recovery cylinder, or in the alternative, from the recovery cylinder to the shipping cylinder, the vapor system including couplings for connection to each of the vapor valves of the cylinders and system vapor valves having at one end thereof an inlet connected directly to the outlets of each vapor and liquid valve; adjacent each of the couplings, said liquid system containing air;

providing a liquid system for connection to the liquid valves of each of the cylinders for establishing fluid communication therebetween, the liquid system including couplings for connecting the liquid system to the respective liquid valves and system liquid valves having at one end thereof an inlet connected directly to the outlets of each vapor and liquid valve; adjacent each of the couplings;

connecting a plurality of recovery cylinders to the vapor system and to the liquid system by means of the couplings having at one end thereof an inlet connected directly to the outlets of each vapor and liquid valve;

opening all valves in the vapor and liquid systems on the cylinders, except for the liquid valve adjacent the coupling for connection to the liquid valve on a shipping cylinder;

operating the vapor pump means to selectively pump air within the system from the recovery cylinder to the coupling for connection to the vapor valves on the shipping cylinder and then to the atmosphere until the vapor pressure at the intake of the vapor pump is below a predetermined value;

closing all liquid valves and the vapor valves of all of the recover cylinders and the system vapor valve adjacent the coupling for the shipping cylinder;

progressively reducing the pressure in the vapor system by opening the vapor valve of one recovery cylinder until the pressure equalizes with the pressure in the vapor system with the pressure in the recovery cylinder and then closing the vapor valve and then sequentially repeating these steps for all other recovery cylinders; and closing the remainder of the valves before disconnecting the couplings from the recovery cylinders whereby the system will be substantially purged of the air in preparation for use.

* * * * *